US009468574B1

(12) United States Patent
Phillips

(10) Patent No.: US 9,468,574 B1
(45) Date of Patent: Oct. 18, 2016

(54) AMBULATORY STRETCHER WITH PATIENT LIFTING MEASURES

(71) Applicant: James Phillips, Floral City, FL (US)

(72) Inventor: James Phillips, Floral City, FL (US)

( * ) Notice: Subject to any disclaimer, the term of this patent is extended or adjusted under 35 U.S.C. 154(b) by 19 days.

(21) Appl. No.: 14/612,628

(22) Filed: Feb. 3, 2015

(51) Int. Cl.
*A61G 7/10* (2006.01)
*A61G 1/048* (2006.01)

(52) U.S. Cl.
CPC ..... *A61G 7/1038* (2013.01); *A61G 1/048* (2013.01); *A61G 7/10* (2013.01); *A61G 7/1011* (2013.01)

(58) Field of Classification Search
CPC .... A61G 7/10; A61G 7/1011; A61G 7/1025; A61G 7/103; A61G 7/1038; B66F 2700/09; B66F 9/02; B65G 13/00
See application file for complete search history.

(56) References Cited

U.S. PATENT DOCUMENTS 2,192,821 A * 3/1940 Torines ..... A61G 7/103 193/35 R
2,565,761 A * 8/1951 Dean ..... A61G 7/1019 188/82.5
2,691,782 A * 10/1954 West ..... A61G 7/1034 198/851
3,042,936 A * 7/1962 Patterson ..... A61G 7/1019 5/83.1
3,099,020 A 7/1963 Davis
3,493,979 A * 2/1970 Crook, Jr. ..... A61G 7/1019 296/17
3,541,617 A * 11/1970 Clanan ..... A61G 7/1019 5/87.1
3,597,773 A 8/1971 Firestone
3,644,944 A 2/1972 Bourgraf
3,815,164 A 6/1974 Smith
3,967,328 A * 7/1976 Cox ..... A61G 1/003 5/81.1 C
4,489,449 A 12/1984 Failor
5,428,851 A * 7/1995 Shore ..... A61G 7/1019 5/424
6,932,209 B2 * 8/2005 Kasagami ..... A61G 7/1032 198/312
6,971,126 B1 * 12/2005 Kluckhuhn ..... A61G 7/1032 5/81.1 R
7,047,578 B2 * 5/2006 Spanton ..... A61G 1/003 414/921
8,052,326 B2 * 11/2011 Pike ..... A61G 1/003 193/35 MD
8,214,943 B2 * 7/2012 Patterson ..... A61G 7/1032 280/771
8,464,371 B1 6/2013 Martin
8,713,730 B2 * 5/2014 Koh ..... A61G 1/003 5/625
2010/0071133 A1 * 3/2010 Bertozzi ..... A61G 1/04 5/627

FOREIGN PATENT DOCUMENTS

CN 102106773 A 6/2012

OTHER PUBLICATIONS

"Interlace." https://web.archive.org/web/20120303005057/http://www.merriam-webster.com/dictionary/interlace. Internet Archive Way Back. Jun. 3, 2016.*

* cited by examiner

*Primary Examiner* — David E Sosnowski
*Assistant Examiner* — Amanda L Miller
(74) *Attorney, Agent, or Firm* — Kyle A. Fletcher, Esq.

(57) ABSTRACT

The ambulatory stretcher with patient lifting measures enables a patient to be loaded onto the ambulatory stretcher without moving. The ambulatory stretcher with patient lifting measures includes an outer frame that includes an opening, and which is adapted to be placed onto the ground immediately surrounding a patient. The outer frame includes a pair of patient-conveying members that extend and retract to close off or open up the opening in the outer frame. The patient-conveying members are able to extend underneath a patient while said patient is lying on the ground surface. Moreover, the patient-conveying members are able to load the patient onto the assembly without requiring any movement of the patient with respect to the ground surface.

7 Claims, 5 Drawing Sheets

AMBULATORY STRETCHER WITH PATIENT LIFTING MEASURES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of patient stretchers, more specifically, a patient stretcher that includes a patient lifting measure therein, and which enables the patient to lie undisturbed on the ground surface whilst being loaded onto said stretcher.

SUMMARY OF INVENTION

The ambulatory stretcher with patient lifting measures enables a patient to be loaded onto the ambulatory stretcher without moving. The ambulatory stretcher with patient lifting measures includes an outer frame that includes an opening, and which is adapted to be placed onto the ground immediately surrounding a patient. The outer frame includes a pair of patient-conveying members that extend and retract to close off or open up the opening in the outer frame. The patient-conveying members are able to extend underneath a patient whilst said patient is lying on the ground surface. Moreover, the patient-conveying members are able to load the patient onto the assembly without requiring any movement of the patient with respect to the ground surface. The patient-conveying members are each constructed of a "U"-shaped frame that includes a top conveyor member and a bottom conveyor member. The "U" shaped frame slides back and forth with respect to a channel located on a left side and a right side of the outer frame. The top conveyor member and the bottom conveyor member are each made of the same construction. Moreover, the top conveyor member and the bottom conveyor member each include a plurality of elongated triangular members that interlace with one another when fully extended into the outer frame, and which are adapted to support the weight of the patient thereon. The top conveyor member and the bottom conveyor member separate from one another when the "U" shaped frame slides outwardly.

These together with additional objects, features and advantages of the ambulatory stretcher with patient lifting measures will be readily apparent to those of ordinary skill in the art upon reading the following detailed description of the presently preferred, but nonetheless illustrative, embodiments when taken in conjunction with the accompanying drawings.

In this respect, before explaining the current embodiments of the ambulatory stretcher with patient lifting measures in detail, it is to be understood that the ambulatory stretcher with patient lifting measures is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ambulatory stretcher with patient lifting measures.

It is therefore important that the claims be regarded as including such equivalent construction insofar as they do not depart from the spirit and scope of the ambulatory stretcher with patient lifting measures. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
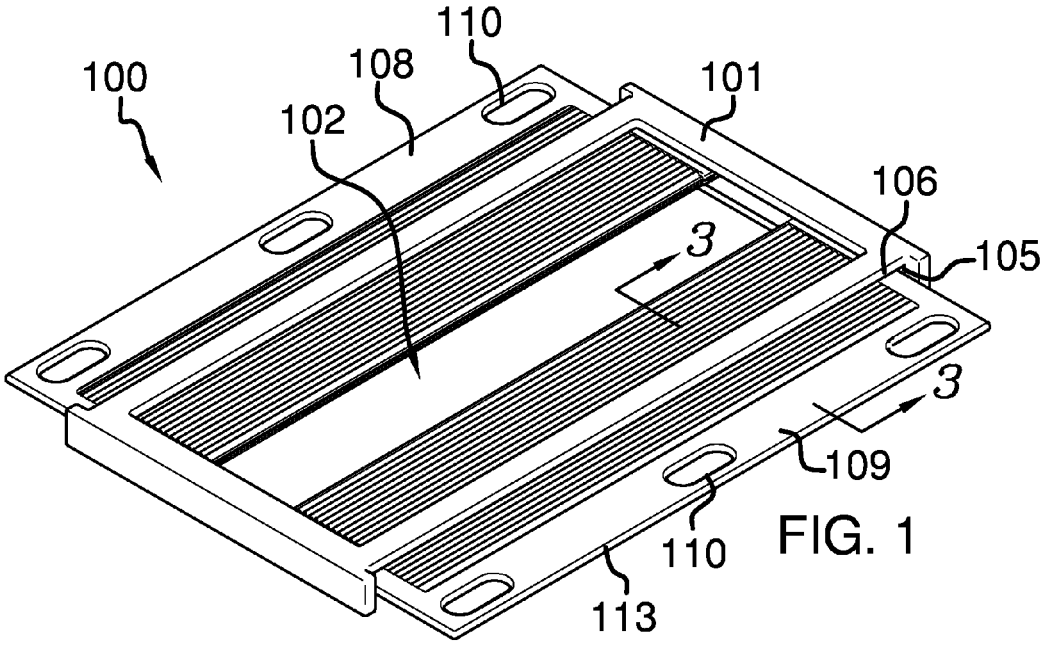
FIG. 1 is a first, perspective view of an embodiment of the disclosure.
Figure 2:
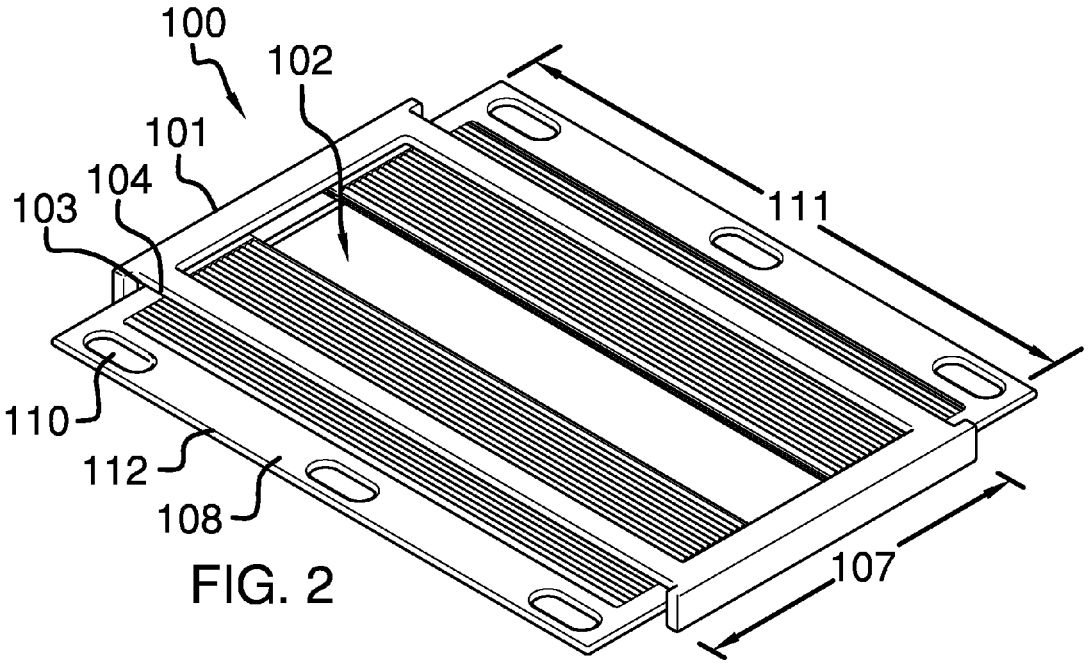
FIG. 2 is a second, perspective view of an embodiment of the disclosure.
Figure 3A:
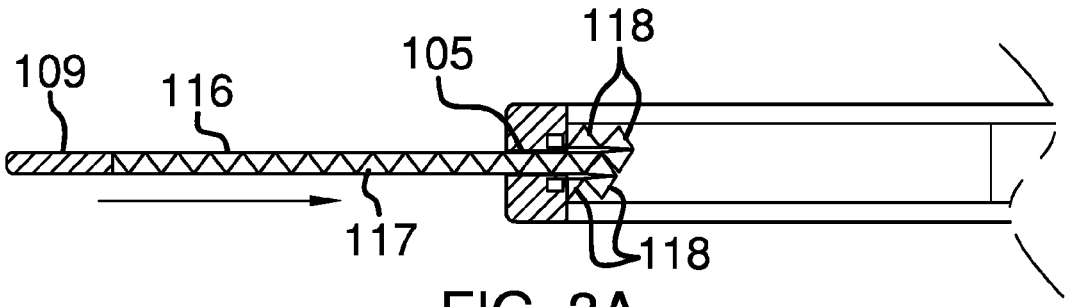
FIG. 3A is a cross-sectional view of an embodiment of the disclosure along line 3-3 in FIG. 1.
Figure 3B:
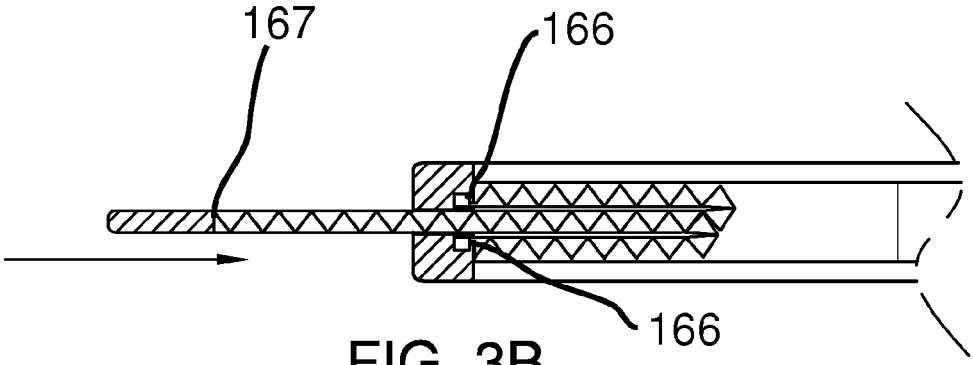
FIG. 3B is a second cross-sectional view of an embodiment of the disclosure along line 3-3 in FIG. 1.
Figure 3C:
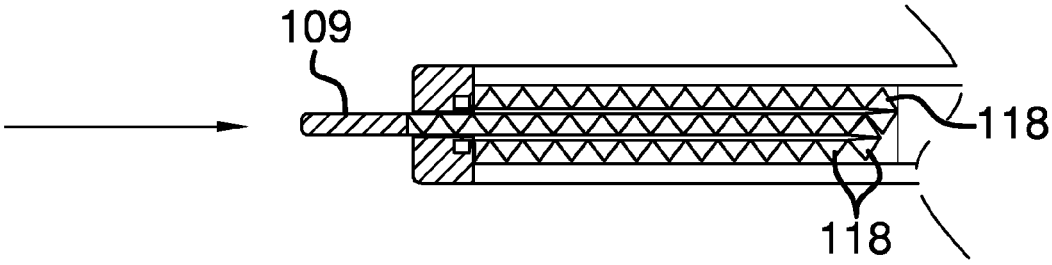
FIG. 3C is a third cross-sectional view of an embodiment of the disclosure along line 3-3 in FIG. 1.
Figure 4:
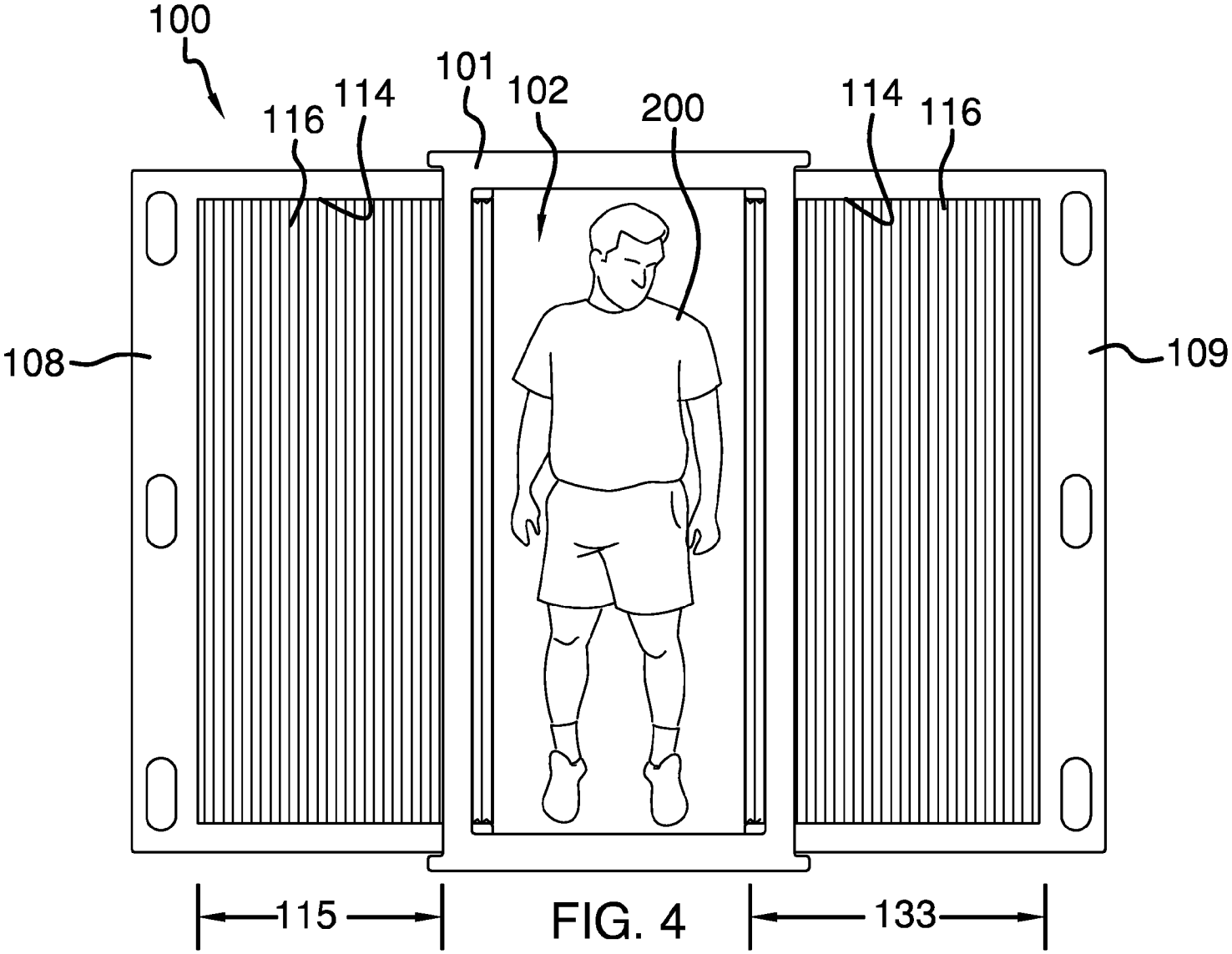
FIG. 4 is a top view of an embodiment of the disclosure in use.
Figure 5:
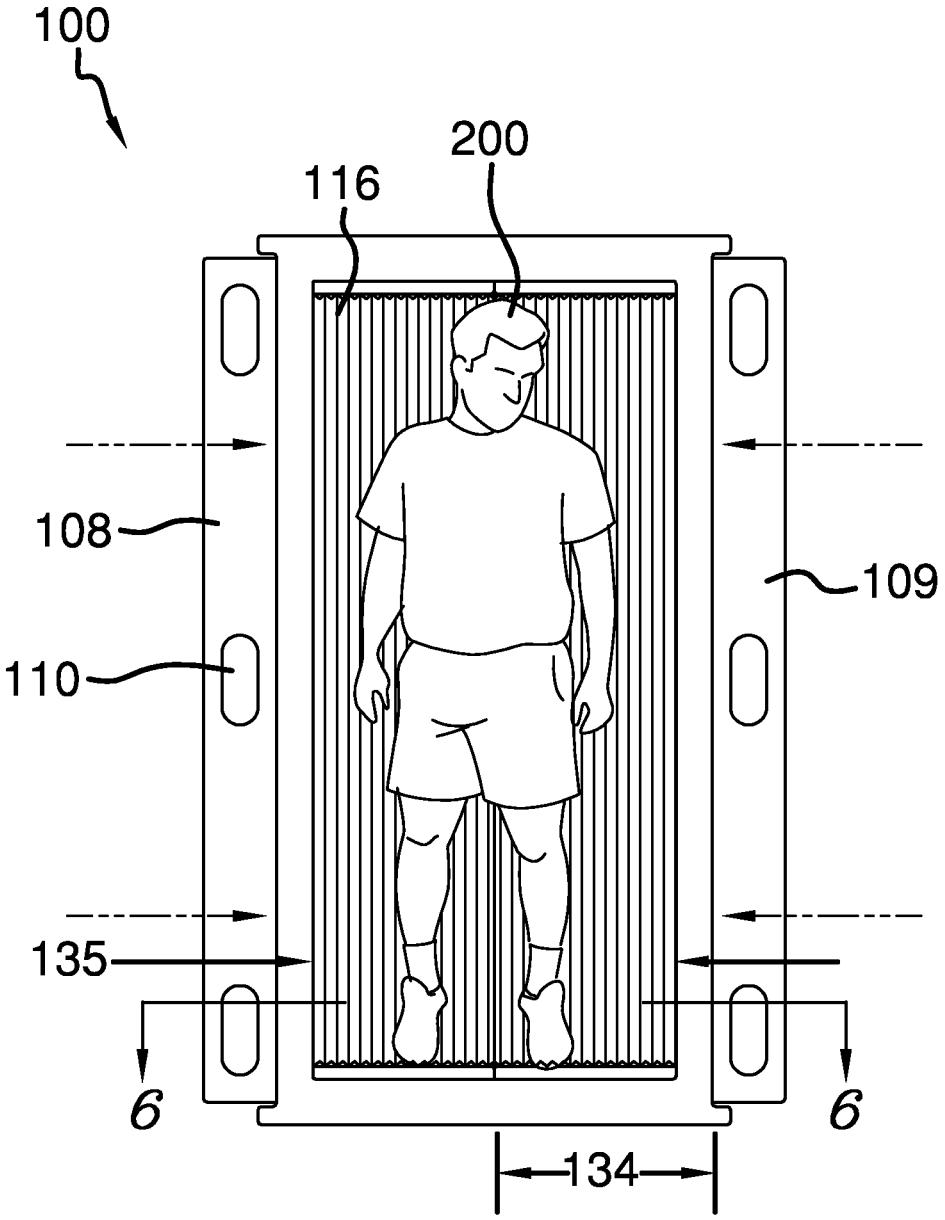
FIG. 5 is another top view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The ambulatory stretcher with patient lifting measures 100 (hereinafter invention) comprises an outer frame 101 that includes an opening 102 thereon. The outer frame 101 is adapted to be placed onto a ground surface immediately surrounding a patient 200. The outer frame 101 includes a left channel 103 along a left side 104 of the outer frame 101, and a right channel 105 along a right side 106 of the outer frame 101. The left channel 103 and the right channel 105 extend across an outer frame width 107 of the outer frame 101. It shall be noted that the patient 200 may also be referred to as an object, and the invention 100 may be adapted for use in lifting said object 200 from said ground surface.

A left "U" shaped frame 108 is attached and slides inwardly as well as outwardly with respect to the left channel 103 of the outer frame 101. A right "U" shaped frame 109 is attached and slides inwardly as well as outwardly with respect to the right channel 105 of the outer frame 101. Both the left "U" shaped frame 108 and the right "U" shaped frame 109 include at least one handhold 110 provided along a "U" shaped frame length 111. More specifically, the left "U" shaped frame 108 includes the at least one handhold 110 adjacent a left frame edge 112 of the left "U" shaped frame 108. The right "U" shaped frame member 109 includes the at least one handhold 110 adjacent a right frame edge 113 of the right "U" shaped frame member 109.

Figure 6:
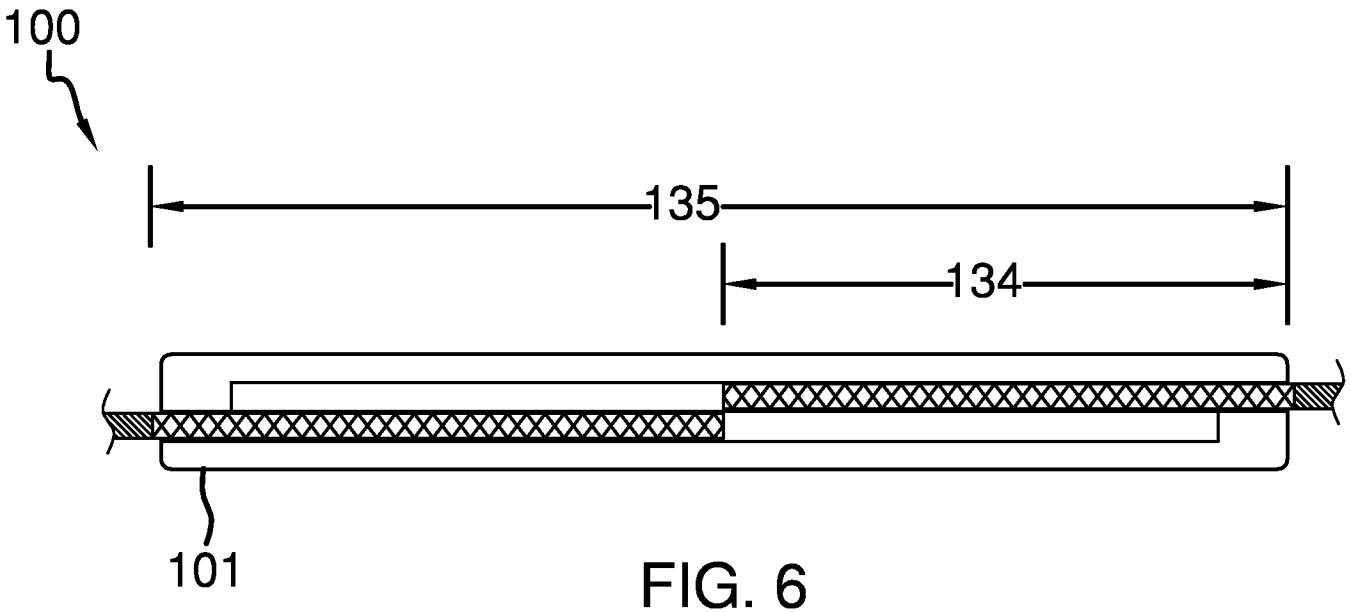
FIG. 6 is another cross-sectional view of an embodiment of the disclosure along line 6-6 in FIG. 5.

The left "U" shaped frame 108 and the right "U" shaped frame 109 have a side opening 114 that corresponds with the respective side of the opening 102 of the outer frame 101. Both the left "U" shaped frame 108 and the right "U" shaped frame 109 are able to slide into and out of the outer frame 101 a traverse length 115. The left "U" shaped frame 108 extends inwardly and overlaps with the right "U" shaped frame 109 (see FIG. 6).

Both the left "U" shaped frame 108 and the right "U" shaped frame 109 include a top conveyor member 116 and a bottom conveyor member 117. The top conveyor member 116 and the bottom conveyor member 117 are constructed of the same materials, and each includes a plurality of elongated triangular members 118 that extend across the side opening 114 of the left "U" shaped frame 108 and the right "U" shaped frame 109. The plurality of elongated triangular members 118 of the top conveyor member 116 are oriented down, whereas the plurality of elongated triangular members 118 of the bottom conveyor member 117 are oriented up. The plurality of elongated triangular members 118 of the top conveyor member 116 are able to interlace with the plurality of elongated triangular members 118 of the bottom conveyor member 117. The interlacing of the plurality of elongated triangular members 118 is able to slide underneath the patient 200, in order to place the patient 200 onto the invention 100 without movement of the patient 200.

It shall be noted that the plurality of elongated triangular members 118 are somewhat flexible, and are able to rotate with respect to one another. The plurality of elongated triangular members 118 are linearly aligned, and successive ones of the plurality of triangular members are able to rotate with respect to one another. The side opening 114 of both the left "U" shaped frame 108 and the right "U" shaped frame 109 is further defined with a side opening width 133.

The top conveyor member 116 and the bottom conveyor member 117 interlace together an interlace length 134. The interlace length 134 is half of the side opening width 133. The interlace length 134 insures that the top conveyor member 116 and the bottom conveyor member 117 extend midway across the opening 102 in the outer frame 101. When both the left "U" shaped frame 108 and the right "U" shaped frame 109 are pushed inwardly, the top conveyor members 116 and the bottom conveyor members 117 extend from the left and the right in order to enclose the opening 102 in the outer frame 101. Moreover, the top conveyor members 116 and the bottom conveyor members 117 have an outer edge 166 that is affixed with respect to the outer frame 101, whilst an inner edge 167 is affixed to either the left "U" shaped frame 108 or the right "U" shaped frame 109.

It shall be further noted that the interlace length 134 is half of an opening width 135 of the opening 102 of the outer frame 101.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An ambulatory stretcher with object lifting measures comprising:

an outer frame with an opening adapted to be placed on a ground surface immediately surrounding an object;

wherein a left "U" shaped frame extends and retracts with respect to a left side of the outer frame;

wherein a right "U" shaped frame extends and retracts with respect to a right side of the outer frame;

wherein both the left "U" shaped frame and the right "U" shaped frame include a top conveyor member and a bottom conveyor member;

said outer frame being configured to receive the left "U" shaped frame and the right "U" shaped frame upon insertion of the left "U" shaped member and the right "U" shaped member, the top conveyor member and the bottom conveyor member interlace and adaptively engage the object from underneath whilst said object is lying on said ground such that the ambulatory stretcher places the object onto the ambulatory stretcher;

wherein the outer frame includes a left channel along a left side of the outer frame, and a right channel along a right side of the outer frame;

wherein the left channel and the right channel extend across an outer frame width of the outer frame;

wherein the left "U" shaped frame is attached to the left channel and slides inwardly as well as outwardly with respect to the left channel of the outer frame;

wherein the right "U" shaped frame is attached to the right channel and slides inwardly as well as outwardly with respect to the right channel of the outer frame;

wherein each of the left "U" shaped frame and the right "U" shaped frame include at least one handhold;

wherein the left "U" shaped frame includes the at least one handhold adjacent a left frame edge of the left "U" shaped frame;

wherein the right "U" shaped frame member includes the at least one handhold adjacent a right frame edge of the right "U" shaped frame member;

wherein each of the left "U" shaped frame and the right "U" shaped frame have a side opening that corresponds with the left side and right side of the outer frame and of the opening of the outer frame respectively;

wherein each of the left "U" shaped frame and the right "U" shaped frame are able to slide into and out of the outer frame a traverse length; wherein the left "U" shaped frame extends inwardly and overlaps with the right "U" shaped frame;

wherein the top conveyor member and the bottom conveyor member are constructed of the same materials, and each of the top and bottom conveyor members include a plurality of elongated triangular members that extend across the side openings of the left "U" shaped frame and the right "U" shaped frame respectively.

2. The ambulatory stretcher with object lifting measures according to claim 1 wherein the plurality of elongated triangular members of the top conveyor member are oriented down, whereas the plurality of elongated triangular members of the bottom conveyor member are oriented up; wherein the plurality of elongated triangular members of the top conveyor member are able to interlace with the plurality of elongated triangular members of the bottom conveyor member.

3. The ambulatory stretcher with object lifting measures according to claim 2 wherein the plurality of elongated triangular members are flexible, and are able to rotate with respect to one another; wherein the plurality of elongated triangular members are linearly aligned, and successive ones of the plurality of triangular members are able to rotate with respect to one another.

4. The ambulatory stretcher with object lifting measures according to claim 3 wherein the side opening of each of the left "U" shaped frame and the right "U" shaped frame is further defined with a side opening width; wherein the top conveyor member and the bottom conveyor member interlace together an interlace length.

5. The ambulatory stretcher with object lifting measures according to claim 4 wherein the interlace length is half of the side opening width; wherein the interlace length insures that the top conveyor member and the bottom conveyor member extend midway across the opening in the outer frame.

6. The ambulatory stretcher with object lifting measures according to claim 5 wherein when both the left "U" shaped frame and the right "U" shaped frame extend inwardly, the top conveyor members and the bottom conveyor members extend from the left side and the right side of the outer frame respectively in order to enclose the opening in the outer frame.

7. The ambulatory stretcher with object lifting measures according to claim 6 wherein the interlace length is half of an opening width of the opening of the outer frame.

* * * * *